United States Patent [19]

Jerome et al.

[11] 4,106,561

[45] Aug. 15, 1978

[54] WELL CASING PERFORATOR

[76] Inventors: Robert J. Jerome, 3726 Mount Ave., Arlee, Mont. 59801; Art Baum, P.O. Box 155, Arlee, Mont. 59821

[21] Appl. No.: 796,226

[22] Filed: May 12, 1977

[51] Int. Cl.[2] ..... E21B 43/112

[52] U.S. Cl. ..... 166/55.2; 166/55.3; 166/55.8; 30/103; 175/269

[58] Field of Search ..... 166/55.2–55.8, 166/100, 298; 175/269, 285; 30/103, 108

[56] References Cited

U.S. PATENT DOCUMENTS

| | | | |
|---|---|---|---|
| 808,235 | 12/1905 | Graham | 166/55.3 |
| 1,497,919 | 6/1924 | Layne | 166/55.3 |
| 2,023,064 | 12/1935 | Clasen et al. | 166/55.2 |
| 3,331,439 | 7/1967 | Sanford | 166/55.8 |

*Primary Examiner*—Ernest R. Purser
*Assistant Examiner*—Nick A. Nichols, Jr.
*Attorney, Agent, or Firm*—Wells, St. John & Roberts

[57] ABSTRACT

A well casing perforator adapted to be used with pneumatically powered rotary drilling equipment. It includes an upright elongated body which is inserted within the casing. The body is attached to the lower end of a drill rod which imparts vertical or angular movement to the elongated body while within the casing. The body is guided axially within the casing by rollers which engage the interior casing wall. A rotatable wheel has teeth capable of penetrating the casing wall as the wheel rolls in engagement with the casing. The wheel is mounted at the outer end of a carrier pivoted to the elongated body about a horizontal axis. The carrier in turn is controlled by a piston assembly subject to pneumatic pressure within the drill rod. The piston assembly is pivotally connected to the carrier to move it from a first position at which the wheel is retracted from engagement with the casing to a second position at which the wheel engages the interior wall of the casing. Upon subsequent downward movement of the body, the wheel and carrier are moved to a third position at which the wheel teeth penetrate the casing as the wheel rolls with its teeth in engagement through the casing. Upward movement of the elongated body following release of pneumatic pressure in the drill rod permits return of the carrier and wheel to their original retracted position.

7 Claims, 4 Drawing Figures

WELL CASING PERFORATOR

BACKGROUND OF THE INVENTION

This disclosure relates to the perforation of a well casing. It was designed specifically for use on water wells, but can be used in conjunction with steel casings on any type of well structure.

The need for perforating a well casing is well known in the drilling industries. By perforating a casing at various depths corresponding to the strata in which liquid is located, one can combine the flow from several different layers to achieve the production requirements of a particular well.

Various types of devices have been previously proposed for perforating well casings. Laterally movable punches are exemplified by the devices shown in the U.S. Pat. Nos. to Jobe, 2,482,913, Frogge, 3,212,580 and Grable, 3,720,262. These involve the application of substantial pressures necessary to push a punch radially through a well casing and to subsequently retrieve the punch for tool removal.

A fluid jet perforator is illustrated in U.S. Pat. No. 3,266,571. Explosive perforators are used widely in oil drilling operations. However, the cost of these devices is such as to make them prohibitive in the drilling of a conventional water well.

A number of patents granted in the period from 1915 to 1924 utilized the rolling engagement of a toothed wheel to perforate the casing of a well. These patents are as follows: Graham, U.S. Pat. No. 1,162,601; Noble, U.S. Pat. No. 1,247,140; Baash, U.S. Pat. No. 1,259,340; Baash, U.S. Pat. No. 1,272,597; Layne, U.S. Pat. No. 1,497,919; Layne, U.S. Pat. No. 1,500,829; and Layne, U.S. Pat. No. 1,532,592.

Most of these patents illustrating a toothed wheel perforating tool utilize inclined slots or guides to cam the wheel radially outward as the perforating tool is moved downwardly in a well casing by mechanical force. They do not provide positive control of the wheel placement for accurate elevational positioning of the resulting perforations. The last two patents to Layne disclose a perforating wheel mounted on a pivoted arm. The arm is wedged radially outward by a mechanical pin controlled by a cable which can be pulled at the working surface. The wheel pressure is directed onto the pin, which will therefore be wedged within the tool under substantial forces. Mechanical arrangements must be provided to accommodate possible breakage of the control cable.

While these patents showing perforation by a rotatable wheel illustrate projected developments more than fifty years old, such perforating tools are not generally available on the market today. The present device has been developed to provide a mechanically simple and effective means for assuring the application of the substantial radial pressures required to perforate steel well casings of the type conventionally used for water wells. The present tool is designed specifically for use in conjunction with conventional pneumatic drilling equipment. No extraneous triggering devices, cables or mechanical interlocks are required. It utilizes the pneumatic pressure conventionally available within the drill rod to preset the wheel for rolling engagement with the wall of the well casing. Actual perforation is accomplished by rolling movement of the extended toothed wheel due to downward movement of the tool under the influence of the connected drill rod. Retraction of the wheel by reverse rolling movement is assured upon the reversal of the movement of the drill rod as the tool is pulled upwardly.

DESCRIPTION OF THE PREFERRED EMBODIMENT

The drawings illustrate an exemplary form of the perforator as used within a steel casing at 10. This particular model of the perforator is scaled for use on water well casings. The standard casing having a 6 inch interior diameter is designed to carry five or six gallons of water per minute. Such a casing typically has a wall thickness of 0.250 inches. In water well drilling, the standard procedure for perforating such a casing is to pull the casing upward to the ground surface, perforate it at the desired elevation by a separate tool and procedure and return it down the bore for use. This process is time consuming and risks damage to both the bore and the casing.

Figure 1:
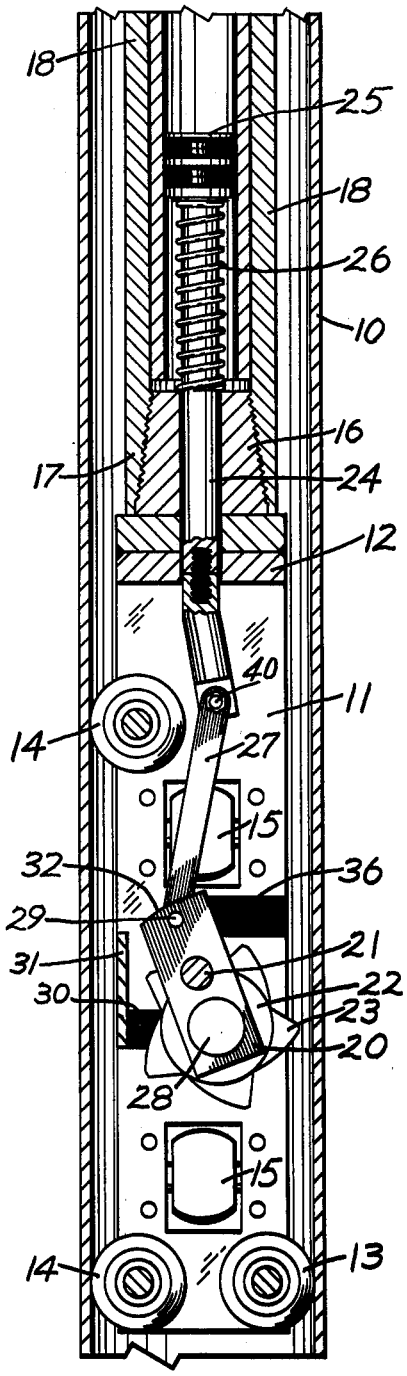
FIG. 1 is a transverse elevation view taken through the perforator within a section of a well casing.

The present tool is designed for use in conjunction with a conventional pneumatic rotary drilling system. It can be used with any type of drilling equipment if auxiliary air pressure is provided to the interior of the drill rods. The lower end of a typical string of drill rods is shown in FIG. 1 at 18. The drill rods are hollow and form a vertical air channel to the tool mechanism at their lower end. The size of equipment used in conjunction with six inch standard water well casings typically employs drill rods having a diameter of four and one half inches.

The drill rods 18 conventionally support a drilling bit (not shown) which is turned by pressurized air supplied at the surface equipment. Air under pressure is blown down through the center of the drill rod 18. It turns the bit and exhausts through the bit to blow the drilled cuttings to the surface. Such drilling systems are widely used today.

No modifications of the drill rods or surface equipment is required to use the present perforator. However, before attaching the tool, the conventional bit backflow valve (not shown) must be removed from the lower end of the drill rod 18 to allow mounting of the perforator tool.

The perforator frame is in the form of an upright elongated body essentially presented by two parallel metal plates 11. The elongated body is arranged along a central longitudinal axis, illustrated as vertical axis A—A, coaxial with the axes of drill rods 18 and well casing 10. Plates 11 are dimensioned to fit freely within the well casing 10 to accommodate vertical movement or turning movement about the casing vertical axis. They are fixed to a horizontal cap 12 at their upper ends and are rigidly spaced apart by a series of roller shafts that mount a front roller 13 and a pair of vertically spaced rear rollers 14 at the front and back sides of the elongated body respectively. The rollers 13, 14 cooperate with four side rollers 15 recessed within the respective plates 11, to engage the interior walls of the well casing 10. Rollers 13, 14 and 15 serve as guide means to maintain the elongated body in a coaxial position along the center axis of well casing 10 and prevent collapsing of casing 10 as it is being perforated.

The upper end of the elongated body is mounted to the lower end of drill rod 18 by means of a threaded male connector 16 fixed to cap 12. The connector 16 is complementary to the conventional threaded lower end 17 provided on the lowermost section of drill rod 18. The threaded connection between the elongated body of the perforator and the drill rod permits the body to be moved vertically and to be rotated about its central vertical axis in response to forces imparted to it through the drill rod 18. Vertical and rotational movement of drill rod 18 is controlled by conventional surface drilling equipment (not shown).

Figure 3:
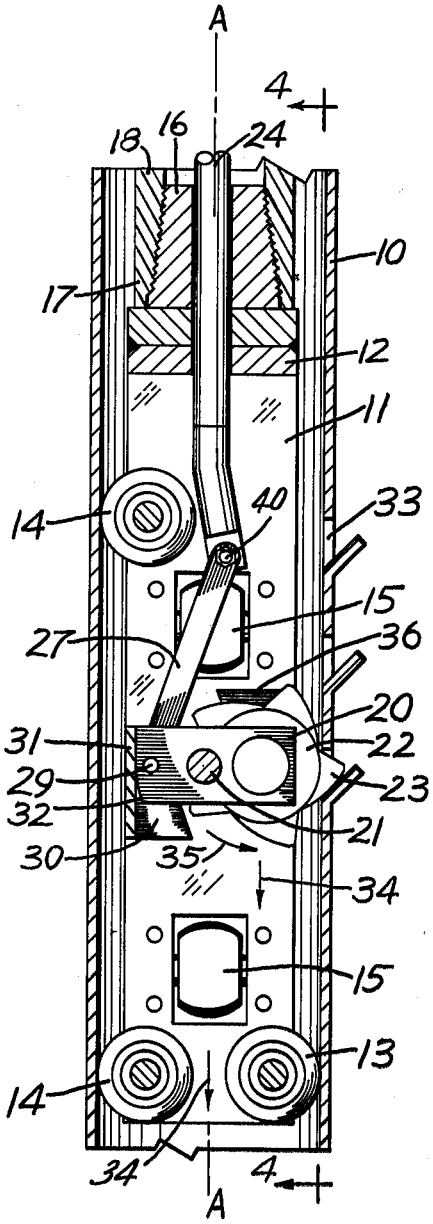
FIG. 3 is a second fragmentary view showing the perforation of the well casing.
Figure 4:
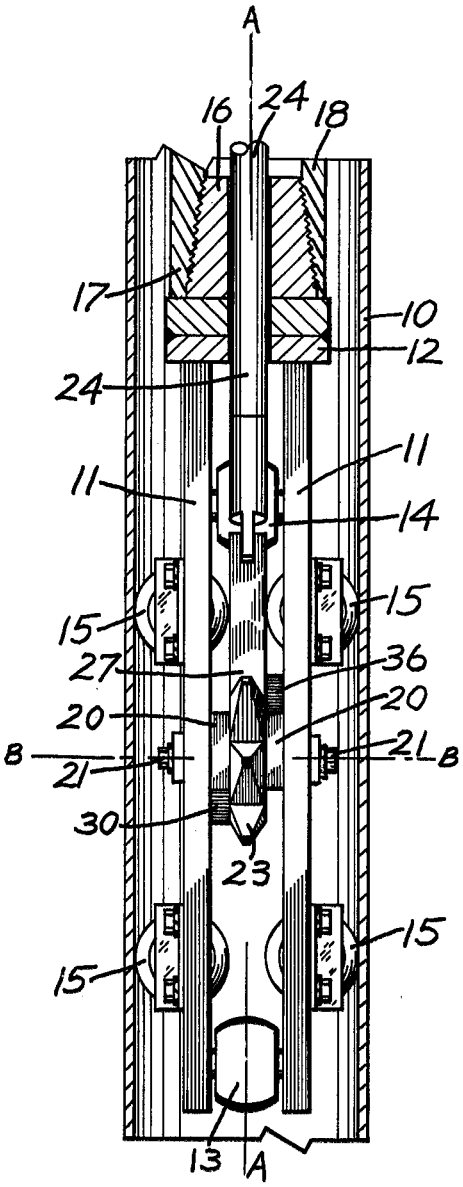
FIG. 4 is a side view of the perforator as seen generally along line 4—4 in FIG. 3, the well casing being broken away for clarity.

Actual perforation of the casing 10 is accomplished by rolling engagement of a wheel 22 having a plurality of radially projected teeth 23 formed about its circular periphery. The teeth 23 are shaped to facilitate puncturing or piercing of the casing 10 as the wheel 22 rotates counterclockwise while rolling downward within the casing. This rolling movement produces a vertical row of evenly spaced openings or apertures 33 (FIG. 3).

The wheel 22 is rotatably supported to one side of a pivoted carrier comprising a pair of carrier plates 20. The plates 20 straddle wheel 22. They are pivotally mounted at the center of plates 11 by outwardly directed stub shafts 21. Shafts 21 pivotally mount carrier plates 20 on the elongated body about a first axis B—B perpendicular to its central longitudinal axis A—A. The shafts 21 are received through the respective plates 11, and pivotally mount carrier plates 20 about a first axis on the elongated body or frame of the perforator. The plates 20 in turn rotatably mount the wheel 22 about a second axis at a wheel shaft 28 parallel to the first axis and spaced to one side thereof. Both the first axis at shafts 21 and the second axis at shaft 28 are horizontal.

The operating mechanism is completed by a pneumatically operated piston assembly. It includes a vertical shaft 24 slidably received through the cap 12 for reciprocating movement along the vertical axis of the well casing 10. The upper end of shaft 24 is enlarged at 25 and includes peripheral seals in sliding engagement against the interior walls of the drill rod 18. Shaft 24 is surrounded by a compression spring 26 which yieldably urges the piston assembly to its upper position shown in FIG. 1. It is movable downwardly in response to air pressure within drill rod 18.

The lower end of shaft 24 is operatively connected to the carrier plates 20 by means of an interposed connecting link 27. Link 27 is pivoted to the carrier plates 20 about a third horizontal axis by a transverse shaft 29. The axis of shaft 29 is positioned at the side of the first axis at 21 opposite to the location of the second axis at 28. Link 27 is pivotally connected to shaft 24 of the piston assembly about a fourth horizontal axis by a pivot connection 40. Both the third axis at 29 and the fourth axis at 40 are also parallel to the second axis B—B.

The wheel 22 is movably mounted on the elongated body for movement radially inward or outward relative to the surrounding well casing. FIG. 1 illustrates the retracted or initial non-operative position of wheel 22. In this first position, the axis of wheel 22 is located at an elevation below the elevation of the axis B—B of the carrier plates 20 at the stub shafts 21 and wheel 22 is clear of the interior wall of casing 10. The plates 20 are angularly located by engagement of an upper abutment or stop 36 fixed to one plate 11. They are held against stop 36 by the action of spring 26.

Figure 2:
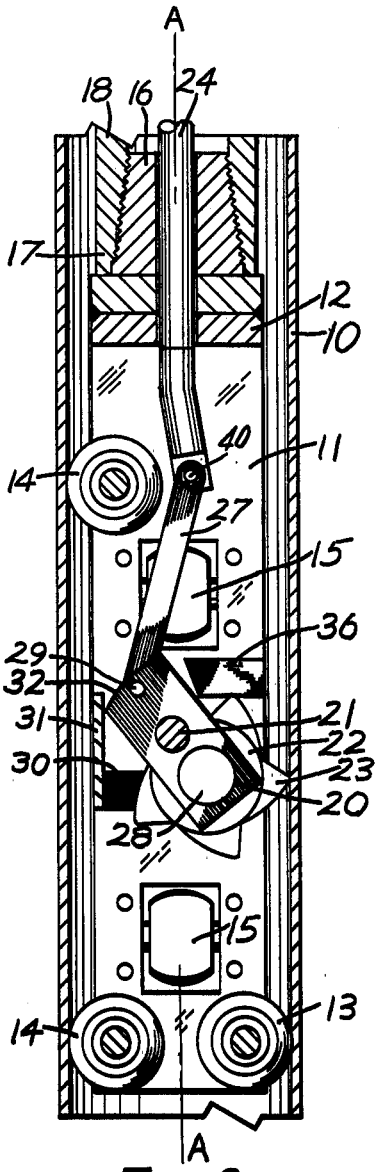
FIG. 2 is a similar fragmentary view showing the wheel preset for rolling engagement against the well casing.

FIG. 2 illustrates the device in readiness for perforation of the well casing 10. Air pressure has been applied to the upper end of the piston assembly, thereby forcing the carrier plates 20 to be pivoted in a counterclockwise direction from the position shown in FIG. 1 to a condition at which the teeth 23 on wheel 22 frictionally engage the interior wall of casing 10. The air pressure required at the piston assembly need not be sufficient to pivot the carrier plates 20 to an angular position wherein the well casing 10 would be actually perforated by the teeth 23.

Starting with wheel 22 in the position shown in FIG. 2, perforation is then accomplished by maintaining the air pressure on the piston assembly as the elongated body of the perforator is forced downwardly in the well casing by movement imparted to it through drill rod 18. As illustrated in FIG. 3, this results in continuing frictional engagement and rolling movement between the teeth 23 of wheel 22 and the well casing 10. The downward direction of movement of the perforator is indicated by arrow 34 and the direction of rotation of wheel 22 is indicated by arrow 35. As the wheel 22 rolls, it is forced radially outward by continued pivotal movement of plates 20 to to the third position shown in FIG. 3. In this third position, the carrier plate 20 has moved beyond the position shown in FIG. 2 to a condition wherein the three axes along the carrier plates 20 are aligned in a common horizontal plane. This is defined by a lower abutment or stop 30 fixed to the inside surface of one plate 11 in the pivotal path of movement of a carrier plate 20. Stop 30 limits the downward movement of the pivotal connection between the carrier plates 20 and the connecting link 27.

An abutment plate 31 spans the separation between the plates 11 and has a vertical surface facing toward the wheel 22. The plate 31 is located alongside the pivotal path of movement of the ends of carrier plates 20 opposite to wheel 22. The inner ends of carrier plates 20 include complementary surfaces 32 shaped to permit sliding engagement between the carrier plates and the abutment plate 31 as the carrier plates 20 reach the horizontal position shown in FIG. 3. Plate 31 serves as a fixed abutment to resist the transverse pressure exerted on the wheel 22 as it rolls along the well casing 10. It serves as a stationary backstop and reinforces the pivotal connections between the carrier plates 20 and the supporting parallel plates 11, in order that the substantial lateral pressure required to perforate the steel well casing will not be transmitted totally to the rotational bearings.

The use of the perforator is believed to be evident from the above disclosure. It can be readily attached to a conventional drill rod assembly and can be lowered to the desired elevation by use of conventional drill control systems and techniques. When wheel 22 is at the elevation at which perforations are desired, it is readied for use by the application of air pressure through drill rod 18. The resulting downward movement of shaft 24 swings the carrier plates 20 and wheel 22 to the second or intermediate condition shown in FIG. 2, with the teeth 23 in frictional engagement with the interior wall of the well casing. Actual perforation is then accomplished by moving the tool downwardly by application of force through the drill rod 18, which completes movement of carrier plates 20 and wheel 22 (FIG. 3). When the desired number of perforations have been completed, as monitored by the distance moved along the drill rod 18, the application of pneumatic pressure through the drill rod 18 is terminated. Wheel 22 is then retracted by lifting the elongated body upwardly in the well casing 20, allowing the teeth 22 to roll out of the perforations or apertures 33. The carrier plates are returned to their first or retracted condition (FIG. 1) by the combined action of the upward rolling movement of wheel 22, the depending wheel weight, and the force exerted on shaft 24 by spring 26. Should any mechanical components fail, the wheel 22 will be free to roll and swing downwardly and inwardly as the perforator is raised from the well casing.

After a desired row of perforations has been formed, the wheel 22 can be retracted and the elongated body can be angularly rotated about the axis of the well casing 10 to position the wheel 22 at a different angular position for production of another row of apertures. By raising and lowering the elongated body at several different angular positions, one can provide any desired number of vertical rows of perforations or apertures through the well casing.

The perforator is mechanically very simple, yet it provides accurate location of apertures along a vertical row. The perforations are accomplished without distorting the well casing configuration, which is maintained by its engagement by the several rollers 13, 14 and 15. These rollers prevent the casing from collapsing. The two rear rollers 14, which are diametrically opposite to the wheel 22 within the casing 10, provide a reaction force in opposition to the pressure applied through the perforating teeth 23. However, this force is applied to a much larger area and does not deform the casing itself.

Having described our invention, we claim:

1. An apparatus for perforating a well casing located within a bore hole, comprising:

an upright elongated body arranged along a central longitudinal axis along its length, and adapted to be inserted within a well casing;

means for mounting the upright elongated body to the end of a drill rod for imparting of movement to said body relative to a well casing in one direction parallel to said central longitudinal axis:

roller means mounted along one side of said upright elongated body about parallel roller axes for rolling engagement within a well casing;

wheel means having a plurality of peripheral outwardly extending teeth;

carrier means pivotally mounted to the upright elongated body about a first fixed axis perpendicular to said central longitudinal axis;

means rotatably mounting the wheel means to said carrier means about a second axis on said carrier means spaced to one side of said first axis and parallel thereto; and movable piston means slidably mounted by said upright elongated body for reciprocating movement relative to said body parallel to said central longitudinal axis;

and means pivotally interconnecting said movable piston means and said carrier means about axes respectively parallel to said first axis for imparting angular movement to said carrier means about said first axis between a first angular position wherein the second axis is elevationally below said first axis and the wheel means is inwardly clear of the well casing, and a second angular position wherein the teeth of said wheel means extend beyond the remaining side of said body and frictionally engage the well casing.

2. A well casing perforator as set out by claim 1 wherein:

the spacing between said first and second axes is such as to permit further angular movement of said carrier means about said first axis beyond said second angular position in response to subsequent motion of said body with respect to the well casing in said one direction.

3. A well casing perforator as set out in claim 1 wherein:

the spacing between said first and second axes is such as to permit further angular movement of said carrier means about said first axis beyond said second angular position in response to subsequent motion of said body with respect to the well casing in said one direction; and fixed means on said body intersecting the angular path of said carrier means about said first axis for limiting such further angular movement at a third angular position of said carrier means about said first axis wherein the teeth of the rolling wheel means fully penetrate the well casing.

4. A well casing perforator as set out in claim 3 further comprising:

an abutment fixed to said one side of said body, said abutment having an upright surface facing toward said carrier means;

and a complementary surface on said carrier means for engagement against said upright surface when said carrier means is located at its third position.

5. An apparatus for perforating a well casing located within a bore hole, comprising:

an elongated body having a central longitudinal axis, said body being of a size to be received within the well casing;

guide means mounted on said body for engagement with the well casing;

carrier means pivotably mounted on said body about a first fixed axis perpendicular to said central longitudinal axis;

wheel means having a plurality of peripheral outwardly extending teeth;

means rotatably mounting said wheel means on said carrier means about a second axis parallel to said first axis and spaced to one side thereof;

movable piston means slidably mounted on said body, for motion parallel to said central longitudinal axis;

means for selectively moving said piston means in one direction;

link means pivotally interconnecting said movable piston means and said carrier means about axes respectively parallel to said first axis for imparting pivotal movement to said carrier means about said first axis in response to movement of said piston means relative to said body in said one direction, whereby the carrier is moved between a first position having said teeth spaced inwardly from the well casing to a second position having said teeth in friction engagement with the well casing;

and means for moving said body relative to the well casing in said one direction for moving said carrier means from said second position to a third position, causing the teeth to perforate the well casing.

6. An apparatus as set out in claim 5 wherein said piston means is spaced from said carrier means along said central longitudinal axis;

said link means comprising a rigid member pivotally connected to said carrier means about a third axis parallel to said first axis and spaced to the remaining side thereof and pivotally connected to said piston means about a fourth axis parallel to said first axis.

7. An apparatus as set out in claim 5 further comprising abutment means on said body in the path of movement of said carrier means for limiting the path of movement of said second axis to locations in said one direction from a plane containing said first axis and perpendicular to said central longitudinal axis.

* * * * *